US010060203B2

(12) United States Patent
Dore et al.

(10) Patent No.: US 10,060,203 B2
(45) Date of Patent: Aug. 28, 2018

(54) WELLBORE EQUIPMENT HANDLING DEVICE

(71) Applicant: Nabors Drilling Canada Limited, Calgary (CA)

(72) Inventors: Richard Dore, Red Deer (CA); Greg Swinamer, Millet (CA)

(73) Assignee: Nabors Drilling Canada Limited (CA)

( * ) Notice: Subject to any disclaimer, the term of this patent is extended or adjusted under 35 U.S.C. 154(b) by 550 days.

(21) Appl. No.: 14/603,225

(22) Filed: Jan. 22, 2015

(65) Prior Publication Data

US 2015/0240576 A1 Aug. 27, 2015

Related U.S. Application Data

(60) Provisional application No. 61/930,422, filed on Jan. 22, 2014.

(51) Int. Cl.
*E21B 19/20* (2006.01)
*E21B 19/15* (2006.01)

(52) U.S. Cl.
CPC ..... *E21B 19/20* (2013.01); *E21B 19/15* (2013.01); *E21B 19/155* (2013.01)

(58) Field of Classification Search
CPC ..... E21B 19/15; E21B 19/155; E21B 19/20
See application file for complete search history.

(56) References Cited

U.S. PATENT DOCUMENTS

| | | | | |
|---|---|---|---|---|
| 4,386,883 | A * | 6/1983 | Hogan | E21B 19/155 414/22.61 |
| 4,462,749 | A * | 7/1984 | Crocker | E21B 19/155 198/360 |
| 5,546,833 | A * | 8/1996 | Holdeman | E21B 19/167 81/52 |
| 6,705,414 | B2 | 3/2004 | Simpson et al. | |
| 9,212,526 | B1 * | 12/2015 | Barnes | E21B 19/155 |
| 9,243,461 | B1 * | 1/2016 | Barnes | E21B 19/155 |
| 2003/0159854 | A1 * | 8/2003 | Simpson | E21B 19/155 175/52 |
| 2009/0252576 | A1 * | 10/2009 | Gerber | E21B 19/00 414/22.54 |
| 2010/0163247 | A1 * | 7/2010 | Wright | E21B 19/155 166/380 |

* cited by examiner

*Primary Examiner* — Giovanna C. Wright

(57) ABSTRACT

A wellbore equipment handling device is disclosed. The wellbore equipment handling device can comprise a catwalk to facilitate movement of a tubular. The catwalk can include a trough to receive the tubular. The trough can extend longitudinally along the catwalk. The catwalk can also include a base to support the trough and an indexer for moving the tubular about the catwalk. The wellbore equipment handling device can also comprise a bucking unit coupled to the base. The bucking unit can be configured to couple and uncouple joints of tubulars and downhole tools. The indexer can be operable to move the tubulars to and from the bucking unit.

31 Claims, 7 Drawing Sheets

WELLBORE EQUIPMENT HANDLING DEVICE

RELATED APPLICATIONS

This application claims the benefit of U.S. Provisional Application No. 61/930,422, filed Jan. 22, 2014, which is incorporated by reference in its entirety herein.

BACKGROUND

Various ground drilling operations are known, such as exploring and/or extracting oil from subterranean deposits. Typically, a drilling operation is conducted on a drill rig comprising a raised drilling platform or work floor located above the drilling location. A derrick is provided on the platform to raise, support and rotate a drill string. A drill string includes a drill bit for boring into the ground to form a wellbore. As the drilling operation continues, tubular members, commonly referred to as "tubulars," "pipes," or "singles," are connected in an end-to-end manner to form a drill string. A catwalk is often used to handle tubulars, such as moving tubulars between a tubular rack and the drill platform or work floor. Tubulars are commonly about 30 feet in length and have opposing female and male ends. The ends are threaded in a complementary manner so that opposing male and female ends can be joined together. To prepare a well for production, a production string can be formed in a similar manner using tubulars or pipes, with completion tools attached at the end of the production string. Most tubulars and/or tools can be threaded on or off a drill or production string using power tongs. When power tongs are inadequate or unavailable a chain wrench can be used to manually make or break such connections. A bucking unit is a device that is also capable of making or breaking tubular and/or tool connections.

BRIEF DESCRIPTION OF THE DRAWINGS

Features and advantages of the invention will be apparent from the detailed description which follows, taken in conjunction with the accompanying drawings, which together illustrate, by way of example, features of the invention; and, wherein.

Figure 1A:
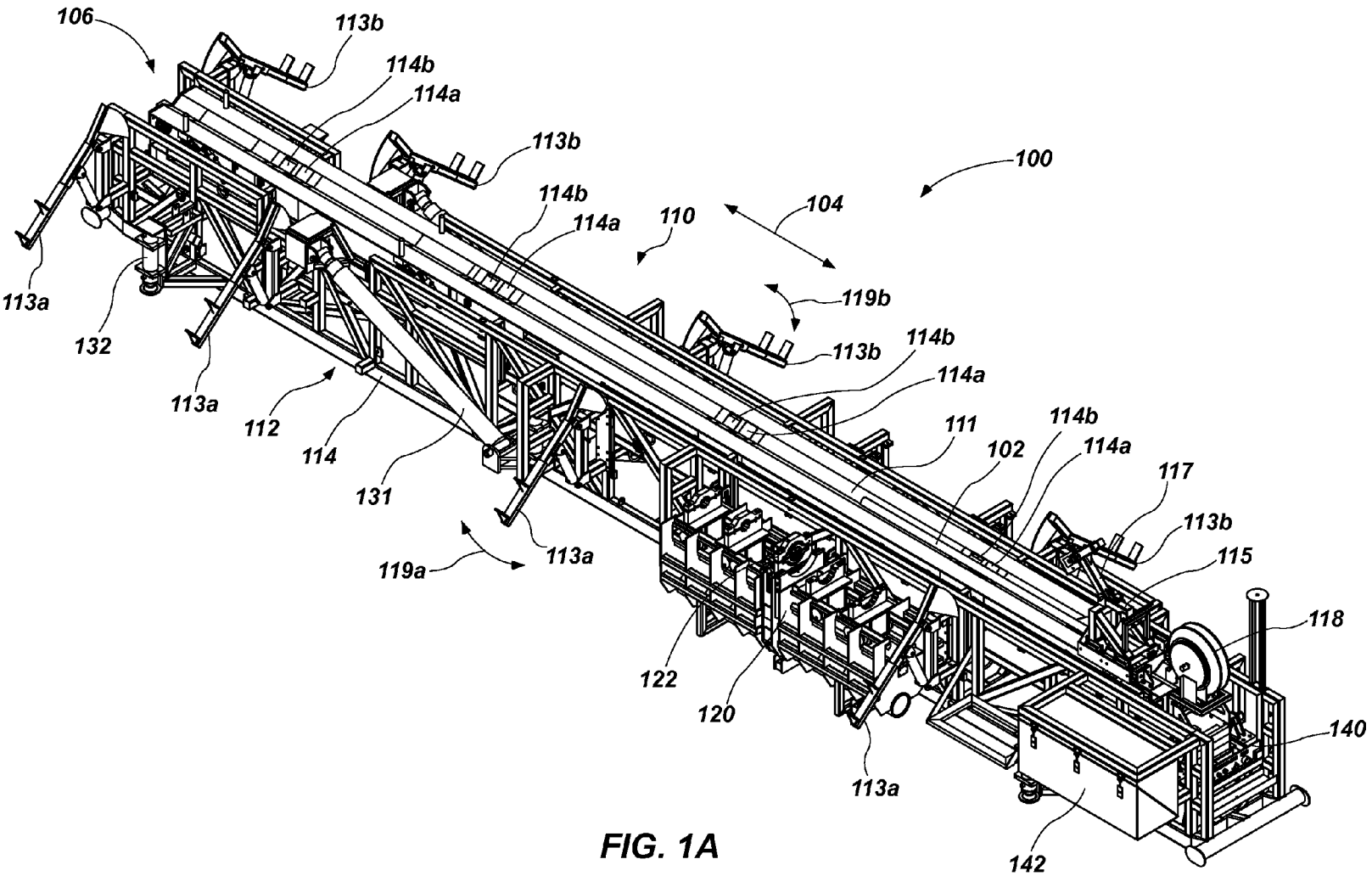
FIGS. 1A and 1B illustrate a wellbore equipment handling device with a catwalk in a horizontal configuration, in accordance with an embodiment of the present disclosure.

Reference will now be made to the exemplary embodiments illustrated, and specific language will be used herein to describe the same. It will nevertheless be understood that no limitation of the scope of the invention is thereby intended.

DETAILED DESCRIPTION

As used herein, the term "substantially" refers to the complete or nearly complete extent or degree of an action, characteristic, property, state, structure, item, or result. For example, an object that is "substantially" enclosed would mean that the object is either completely enclosed or nearly completely enclosed. The exact allowable degree of deviation from absolute completeness may in some cases depend on the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result.

As used herein, "adjacent" refers to the proximity of two structures or elements. Particularly, elements that are identified as being "adjacent" may be either abutting or connected. Such elements may also be near or close to each other without necessarily contacting each other. The exact degree of proximity may in some cases depend on the specific context.

An initial overview of technology embodiments is provided below and then specific technology embodiments are described in further detail later. This initial summary is intended to aid readers in understanding the technology more quickly but is not intended to identify key features or essential features of the technology nor is it intended to limit the scope of the claimed subject matter.

Although power tongs are in widespread use for making and breaking tubular and/or tool connections, power tongs are limited in the range of sizes that can be handled and in torque output. If power tongs cannot be used or are ineffective, the only other option available in most field applications is a chain wrench, which requires the manual application of a large amount of torque to be applied to the tubular and/or tool connections. This option can compromise the safety of field operators because while applying the torque, any mishaps or slippage of the chain wrench can lead to broken bones, fingers, hands, teeth, chin, knee, and/or other injuries to drill rig personnel. Although bucking units can make or break tubular and/or tool connections, prior bucking units are typically bulky, expensive, and require cranes or other such lifting devices in order to handle tubulars for use with the bucking units. Additional space and extra hydraulic power units, for example, in addition to those for powering catwalks and other devices, are also typically required to run such bucking units, which make bucking units cumbersome to use in a drill rig environment, and therefore not practical for most field applications.

Accordingly, a wellbore equipment handling device is disclosed that integrates the tubular handling capabilities of a catwalk and the tubular and tool making/breaking (coupling/decoupling) capabilities of a bucking unit. In one aspect, the combination catwalk and the bucking unit can share a common power source. The wellbore equipment handling device can comprise a catwalk to facilitate movement of a tubular. The catwalk can include a trough to receive the tubular. The trough can extend longitudinally along the catwalk. The catwalk can also include a base to support the trough and an indexer for moving the tubular about the catwalk. The wellbore equipment handling device can also comprise a bucking unit coupled to the base. The bucking unit can be configured to couple and uncouple joints of tubulars and downhole tools. The indexer can be operable to move the tubulars to and from the bucking unit.

Also disclosed is a system for facilitating wellbore operations, the system comprising a base; a trough supported about the base, the trough being configured to receive a tubular; a plurality of indexers coupled to the base and spaced longitudinally, the indexers being operable alone or in combination to manipulate movement of the tubular relative to the trough; at least one kicker located along the length of the trough and operable to move the tubular out of the trough towards the indexers; and a torqueing assembly supported about the trough, the torqueing assembly being operable to facilitate coupling or uncoupling of a second tubular and/or a downhole tool, wherein movement of either of the tubular or the second tubular is secured relative to movement of the other or the downhole tool, and wherein the indexers are configured to move the tubular to/from the torqueing assembly.

Also disclosed is a method for facilitating tubular handling and coupling/uncoupling from a single wellbore equipment handling device and system, the method comprising: providing a catwalk operable to handle and manipulate tubulars; integrating a bucking unit with the catwalk, the bucking unit operable to couple and uncouple joints of the tubulars and downhole tools.

Also disclosed is a method for facilitating, at least in part, a wellbore operations, the method comprising: obtaining a wellbore equipment handling device comprising a combination of a catwalk and bucking unit integrated with one another; operating the wellbore equipment handling device to move one or more tubulars and/or downhole tools, and to couple and/or uncouple the joints of the tubulars and the downhole tools.

Figure 1B:
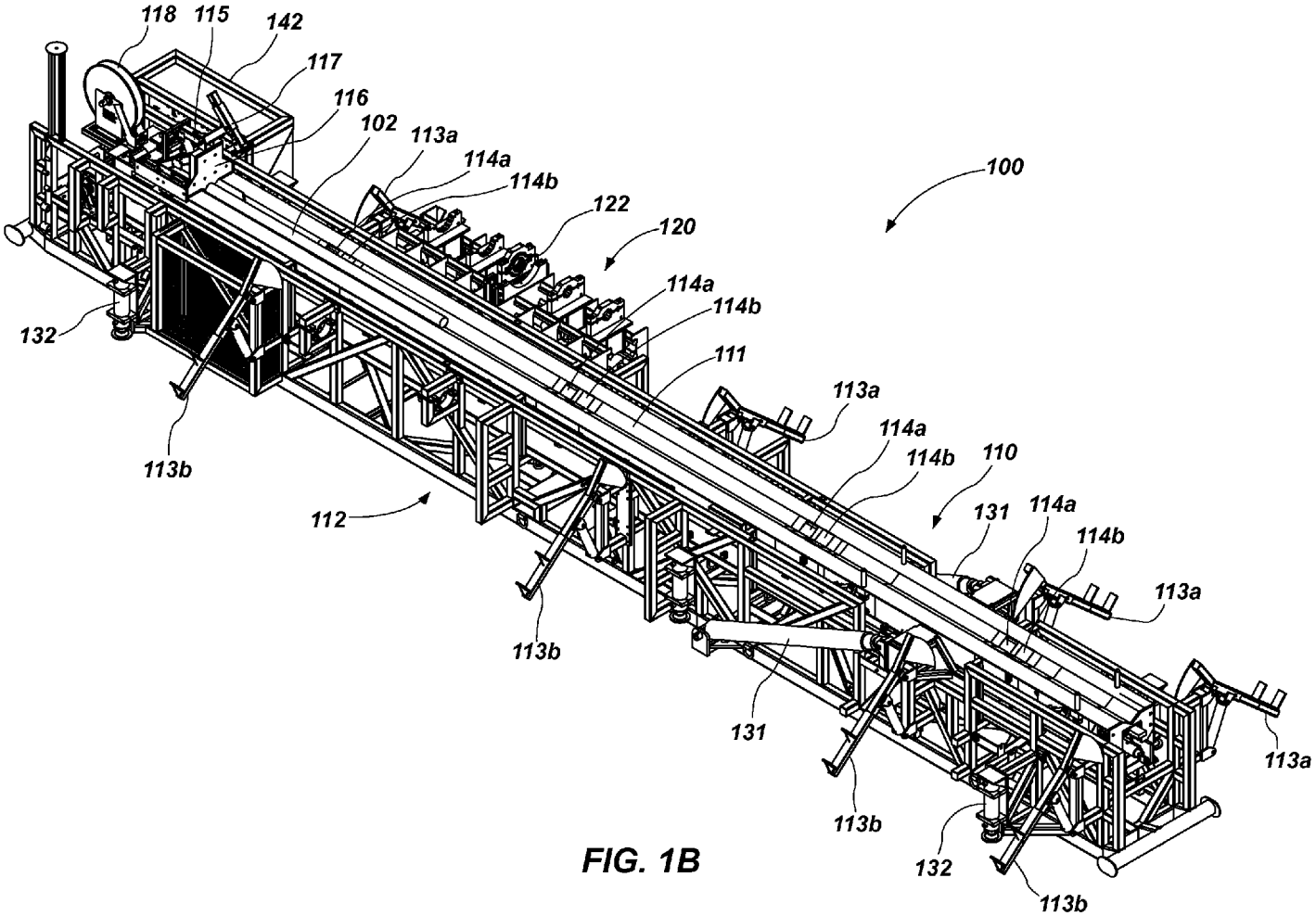
Figure 1C:
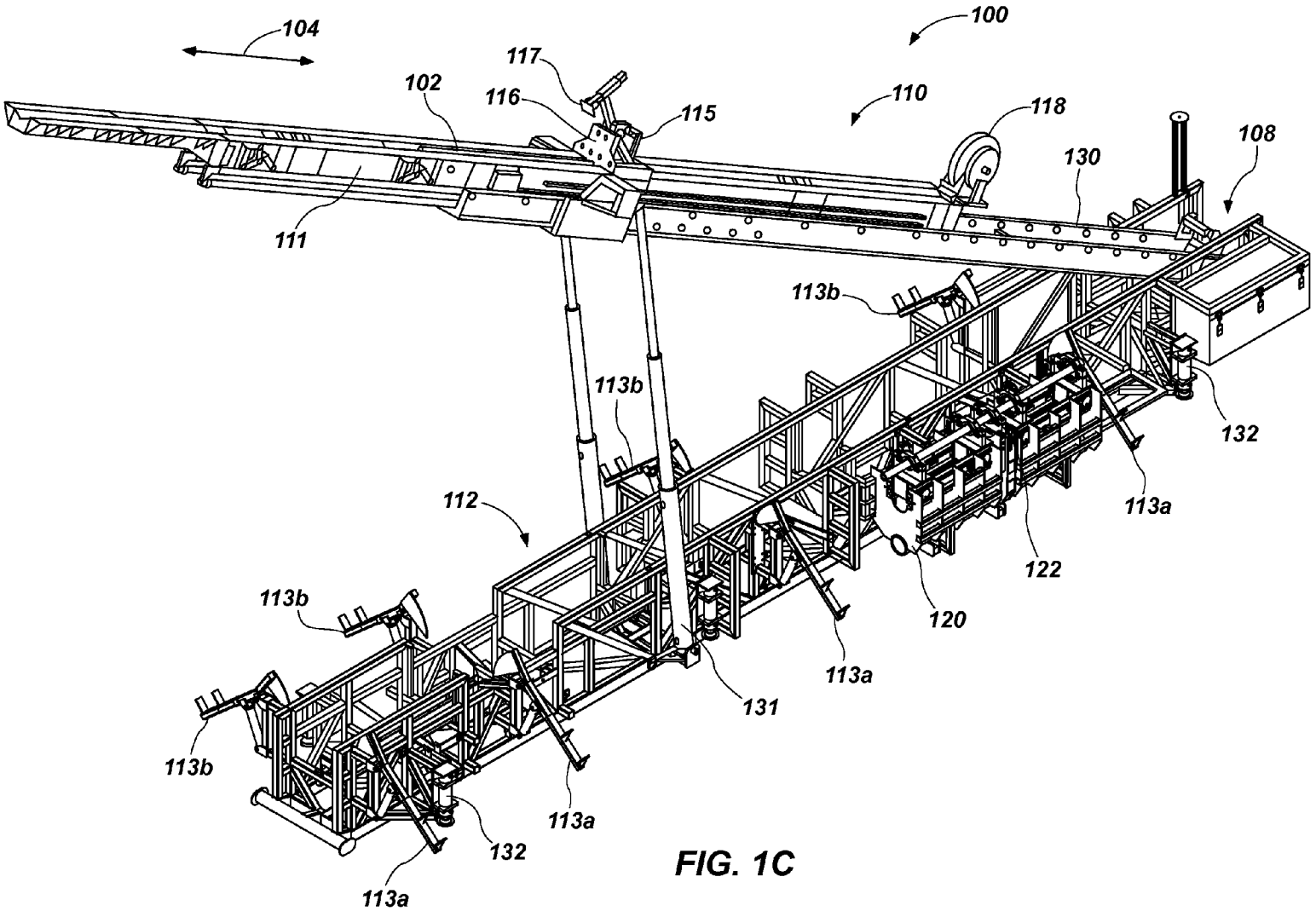
FIG. 1C is an example illustration of the wellbore equipment handling device of FIGS. 1A and 1B with the catwalk in an elevated configuration.

One embodiment of a wellbore equipment handling device/system 100 is illustrated in FIGS. 1A-1C. The wellbore equipment handling device 100 can comprise a catwalk 110, which can include a trough 111 and a base 112 to support the trough 111. The wellbore equipment handling device 100 can also comprise a bucking unit 120 coupled to the base 112, such that the catwalk 110 and the bucking unit 120 form a single integrated device and system operable with one another within the same device and system. The catwalk 110 can be configured to move tubulars to and from the work floor, as well as to and from the bucking unit 120, which can be used to couple and uncouple joints of tubulars using a torque arm 122. Tubulars are provided on a rack (not shown) from which they are individually rolled onto the catwalk 110 when in the horizontal configuration shown in FIGS. 1A and 1B. In one aspect, the trough 111 of the catwalk 110 can be configured to receive one or more tubulars 102. The catwalk 110 can also include at least one indexer, such as indexers 113*a*, 113*b*, at least one kicker, such as kickers 114*a*, 114*b*, and a skate 115, these being operable to move tubulars about the catwalk.

The indexers 113*a*, 113*b* can be located along the catwalk 110 to move tubulars to and from a rack located on a side of the catwalk 110. For example, as shown in the figures, the indexers 113*a*, 113*b* can be coupled to the base 112 and spaced longitudinally along sides of the catwalk 110. The indexers 113*a*, 113*b* can take various forms and can have various modes of operation but, fundamentally, the indexers are configured to manipulate movement of the tubulars relative to the rack, such as to urge movement of the tubulars on to or off of the catwalk 110. The indexers 113*a*, 113*b* can therefore replace manual operators such that personnel need not be in this dangerous area or operating zone. In the illustrated embodiment, the indexers 113*a* operate on one side of the catwalk 110, while the indexers 113*b* operate on the opposite side. In one embodiment, each indexer includes an arm that is pivotally coupled to the base and has an upper surface to interface with the tubulars. The arms can be connected to a drive mechanism that causes upward or downward rotation of the arms in directions 119*a*, 119*b* to maneuver the tubulars. A drive mechanism for the indexers can include a hydraulic cylinder or other suitable actuator. By causing upward rotation of the indexer arm, a tubular can be moved from a rack to the catwalk, such as loading tubular into the trough 111. On the other hand, by causing downward rotation of the indexer arm, a tubular can be moved from the catwalk 110 to the rack. The indexers on one side, for example all indexers 113*a*, may be operated in unison, as by use of connected plumbing for the hydraulic cylinders, such that they together act to control tubular movement. Thus, the indexers on one side of the catwalk 110 can be selected to operate to either move tubulars into the trough 111 or away from the catwalk 110, or both, since in most operations the tubulars will be moved to and from the racks on both sides of the catwalk 110 repeatedly.

The kickers 114*a*, 114*b* can be located along the trough 111 to move tubulars out of the trough toward the indexers 113*a*, 113*b*. For example, as shown in the figures, the kickers 114*a*, 114*b* can be configured to extend out of the trough 111 through openings in the trough 111 spaced longitudinally along the trough 111. The kickers 114*a*, 114*b* can have various forms and can have various modes of operation. The kickers 114*a* operate on one side of the trough 111, while the kickers 114*b* operate on the other side of the trough 111 to direct tubulars to opposite sides of the catwalk 110. In the illustrated embodiment, each kicker 114*a*, 114*b* is mounted in a recess or opening and has an upper surface formed to coincide generally with or be recessed below the V-shaped surface of the trough 111 when in a retracted or non-extended position. Each kicker 114*a*, 114*b* can be connected to an actuator to move the kicker. In one aspect, the kickers 114*a*, 114*b* can be pivotally mounted and actuated by a hydraulic cylinder. When actuated, the kickers 114*a*, 114*b* can protrude above trough 111 surface in which it is mounted to abut against a tubular positioned in the trough 111. Thus, a tubular in the trough 111 can be rolled out of, or ejected from, the trough 111 away from the kickers 114*a*, 114*b*. When deactivated, the kickers 114*a*, 114*b* can be returned flush with the trough 111 surface so that the tubulars can pass over unobstructed. In one aspect, the kickers 114*a* on one side of the trough 111 can be operated in unison such that they act together on a tubular while the kickers 114*b* on the opposite side of the trough 111 remain inactive. When a tubular is being moved into the trough 111, the surfaces of all of the kickers 114*a*, 114*b* can remain flush with or recessed below the surface of the trough 111 to avoid interference with the tubular.

The skate 115 can be configured to move back and forth in a longitudinal direction 104 along the trough 111 to move tubulars along the trough 111. For example, the skate 115 can include a push plate 116 or any other suitable device or structure configured or operable to push on the tubular 102 to move the tubular 102 toward the end 106 of the trough 111. The skate 115 can also include a clamp 117 or other type of grabbing mechanism configured or operable to clamp or secure an end of the tubular 102 to move the tubular 102 in a direction away from the end 106 of the trough 111. In some embodiments, the skate 115 can be operable with and configured to move along a guide track of the catwalk 110 along the trough 111. To move the skate 115, the catwalk 110 can comprise a drive mechanism. In one embodiment, the drive mechanism can comprise a drive winch 118, which can have a front drive cable that can extend from the winch 118 to a front idler sheave and back in order to couple to a front of the skate 115. The winch 118 can further comprise a rear drive cable that can extend from the winch 118 to a rear idler sheave and back to couple to a rear of the skate 115. Thus, the skate 115 can push on the tubular 102 to move the tubular toward the end 106 of the trough 111 to maneuver the tubular 102 along the trough 111, such as for delivery of the tubular 102 to the work floor. On the other hand, using the damp 117, the skate 115 can secure the tubular 102 and move the tubular 102 away from the end 106 of the trough 111 to maneuver the tubular 102 along the trough 111, such as to retrieve the tubular 102 from the work floor.

The indexers 113*a*, 113*b*, kickers 114*a*, 114*b*, and skate 115 can therefore function, alone or in any combination, to move and/or position tubulars about the catwalk 110. For example, the indexers 113*a*, 113*b* can be actuated to move a tubular from a rack to the trough 111 for delivery to the work floor. The indexers 113*a*, 113*b* can also be used along with the kickers 114*a*, 114*b* to move a tubular from a rack on one side of the device 100 to a rack on an opposite side across the catwalk 110. In addition, the indexers 113*a*, 113*b* can be used to move tubulars to and from the bucking unit 120 for coupling or uncoupling a joint, as desired. The skate 115 can be used, as needed, to move or position a tubular longitudinally along the trough 111 so that the kickers 114*a*, 114*b* and indexers 113*a*, 113*b* can be used to place the tubular on a rack or on the bucking unit 120, which can be used to couple or uncouple tubulars. The indexers 113*a*, 113*b* can also be used to move tubulars from the bucking unit 120 to another location, such as the trough 111 or a rack.

Accordingly, the bucking unit 120 can be coupled to the base 112 of the catwalk 110 in a location suitable to facilitate transfer of tubulars to and from the catwalk 110 using the indexers 113*a*, 113*b*. For example, the bucking unit 120 can be coupled to the base 112 on either side of the catwalk 110 or longitudinally anywhere along the catwalk 110. In one aspect, the bucking unit 120 can be located on a driller or drill rig side of the catwalk 110. In another aspect, the bucking unit 120 can be configured to work at about the same height level as the catwalk 110, which can reduce or minimize manual handling of tubulars and/or downhole tools. The bucking unit 120 and the catwalk 110 can therefore be combined together and integrated in a manner that facilitates ease of transfer of tubulars between the two components. Such integration provides for the safe and efficient making and breaking of tubular connections while reducing or minimizing the risk of injuries to field operators.

For example, once a tubular has been delivered to the work floor, an end of the tubular is oriented over the existing drill string and connected to the terminal or surface end of the drill string. Following connection of the tubular to the drill string and "torqueing" to establish a tight connection, the drilling operation is continued. The frequency of adding tubulars to the drill string is high and, therefore, the efficiency of the drilling operation is hindered each time a tubular is to be connected. In addition, manipulation of the tubulars for connection to the drill string often requires manual handling and, therefore, poses risks to the drill rig personnel.

The efficiency of the drilling or production operation can be increased by pre-connecting at least two tubulars to form a "stand" prior to connection to the drill or production string. This process is often referred to as "standbuilding." Such a pre-connection step involving two tubulars will reduce by half the number of connections required to be made to the string and, therefore, allows the drilling or production string building process to continue with fewer interruptions. For example, during formation of the stand, the drilling operation can be continued without interruption. The bucking unit 120 as combined and integrated with the catwalk 110, as disclosed herein, is ideally situated for efficient standbuilding. Thus, in one aspect, the bucking unit 120 can be configured to be used for standbuilding, such as by sizing the catwalk 110 and/or the bucking unit 120 appropriately. The tubulars can be moved from the catwalk 110 to the bucking unit 120 using the skate 115, kickers 114*a*, 114*b*, and indexers 113*a*, 113*b*, as needed, and with minimal manual labor. Once two or more tubulars are joined by the bucking unit 120 to form a stand, the stand can be moved from the bucking unit 120 to the catwalk trough 111 using the indexers 113*a*, 113*b*, and delivered to the drill platform where it can be secured to the drill or production string. For example, both the rack and catwalk 110 can be located adjacent to the drilling platform or work floor, with the catwalk 110 being generally positioned perpendicular to the platform or floor. Once on the catwalk 110, the tubular or stand can be moved to the drilling platform or work floor by the skate 115.

In some cases, the work floor can be elevated above the catwalk 110. Therefore, as shown in FIG. 1C, the catwalk 110 can be configured to elevate an end 106 of the trough 111 up to the work floor. For example, in some embodiments the end of the trough 111 can be elevated up to about 35 feet. In one aspect, the trough 111 can comprise first and second components that are movable relative to one another, these being configured to telescope or extend longitudinally to extend a length of the trough 111 and facilitate moving tubulars to or from the work floor. Extending the length of the trough 111 may also contribute to reaching even greater heights. To facilitate elevation of the trough 111, the catwalk 110 can include a frame 130 that is pivotally coupled to the base 112 at one end, such as end 108, and that is coupled to or otherwise in support of the trough 111. Trough elevators 131, which can include hydraulic cylinders (or other forms or types of actuators (e.g., pneumatic, electrical, etc.)), can be coupled to the frame 130 and the base 112 to elevate an opposite end of the frame 130, causing rotation of the frame 130 about the pivotal coupling, thus elevating the trough 111, or at least a portion thereof. With the trough 111 elevated to the work floor, the skate 115 can move the tubular or stand along the trough 111 to deliver the tubular or stand to the work floor. When a tubular or stand is being retrieved from the work floor, the skate 115 can move the tubular or stand along the trough 111 sufficient to permit the trough 111 to be lowered to the horizontal configuration, where the tubular can be placed on a rack or the stand can be moved to the bucking unit 120 to uncouple the tubulars, as desired. The skate 115 can therefore push or pull tubulars longitudinally along the trough 111 to position the tubulars for kicking, indexing, or delivery.

In some embodiments, the wellbore equipment handling device/system 100 can be configured in dimension for mobility about a mobile device, such as for transport as a trailer, or on a flatbed trailer for skidding into position near a well drilling or servicing rig. Accordingly, the combination catwalk 110 and bucking unit 120 can be trailer mounted or skid mounted. For example, the base 112 can be configured as a trailer or as a skid. As shown in the figures, the base 112 can comprise a lattice frame structure, which can provide a stable support for the catwalk 110 and the bucking unit 120 while minimizing weight to facilitate transport of the wellbore equipment handling device/system 100. The base 112 can also have one or more leveling jacks 132 disposed around the perimeter of the base 112 that can individually raise or lower the trough 111 relative to the ground to bring the trough 111 to a level or horizontal position, and/or to align with a rack. The jacks 132 can be hydraulically operated, electrically operated, and/or manually operated to raise or lower trough.

The wellbore equipment handling device/system 100 can comprise electrical and/or internal combustion power sources or motors to operate the functional features of the catwalk 110 and/or the bucking unit 120, such as the indexers 113*a*, 113*b*, kickers 114*a*, 114*b*, skate 115, trough elevators 131, leveling jacks 132, and/or torque arm 122. In some embodiments, the wellbore equipment handling device 100 can comprise a hydraulic power assembly and hydraulic fluid tank disposed on or about the base. The hydraulic power assembly can be driven by one or more motors 140, such as an electrical motor or an internal combustion engine, such as a diesel engine. In embodiments that utilize an electric motor, the wellbore equipment handling device 100 can comprise an electrical box to house electrical distribution panels configured to be connect electrical power, such 480 VAC or 600 VAC, 3-phase, 60 Hz alternating current electricity, as supplied from available commercial AC power or on-site AC power generators, to all of the electrically-powered components and devices used in the operational control of the wellbore equipment handling device/system 100. As used herein, the term "motor" can include electrical motors, internal combustion motors, and hydraulic motors. In addition, the term "actuator" can include hydraulic, pneumatic and/or electro-mechanical actuators.

In some embodiments, the wellbore equipment handling device/system 100 can comprise a control unit. In can include one or more sets of controls disposed on a control panel 142 on the base 112. Thus, some or all of the functions of the wellbore equipment handling device/system 100 can be controlled from a central or single location on the device 100. For example, various start/stop and emergency shutdown (ESD) controls can be disposed on the control panel to provide means to start and stop the various operations the wellbore equipment handling device/system 100. The wellbore equipment handling device/system 100 can also include manual hydraulic valve controls disposed on the control panel 142 to facilitate operation of the hydraulically-operated devices of the wellbore equipment handling device/system 100. In one aspect, the wellbore equipment handling device/system 100 can comprise wireless interface electronics to operate some or all of the functional features of the wellbore equipment handling device 100 using a wireless remote control device. Thus, some or all of the functions of the wellbore equipment handling device 100 can be controlled by a wireless communication device remote from the catwalk and bucking unit components at a safe location away from dangerous areas in which these are placed or located, which can improve safety for an operator of the wellbore equipment handling device/system 100.

Figure 2A:
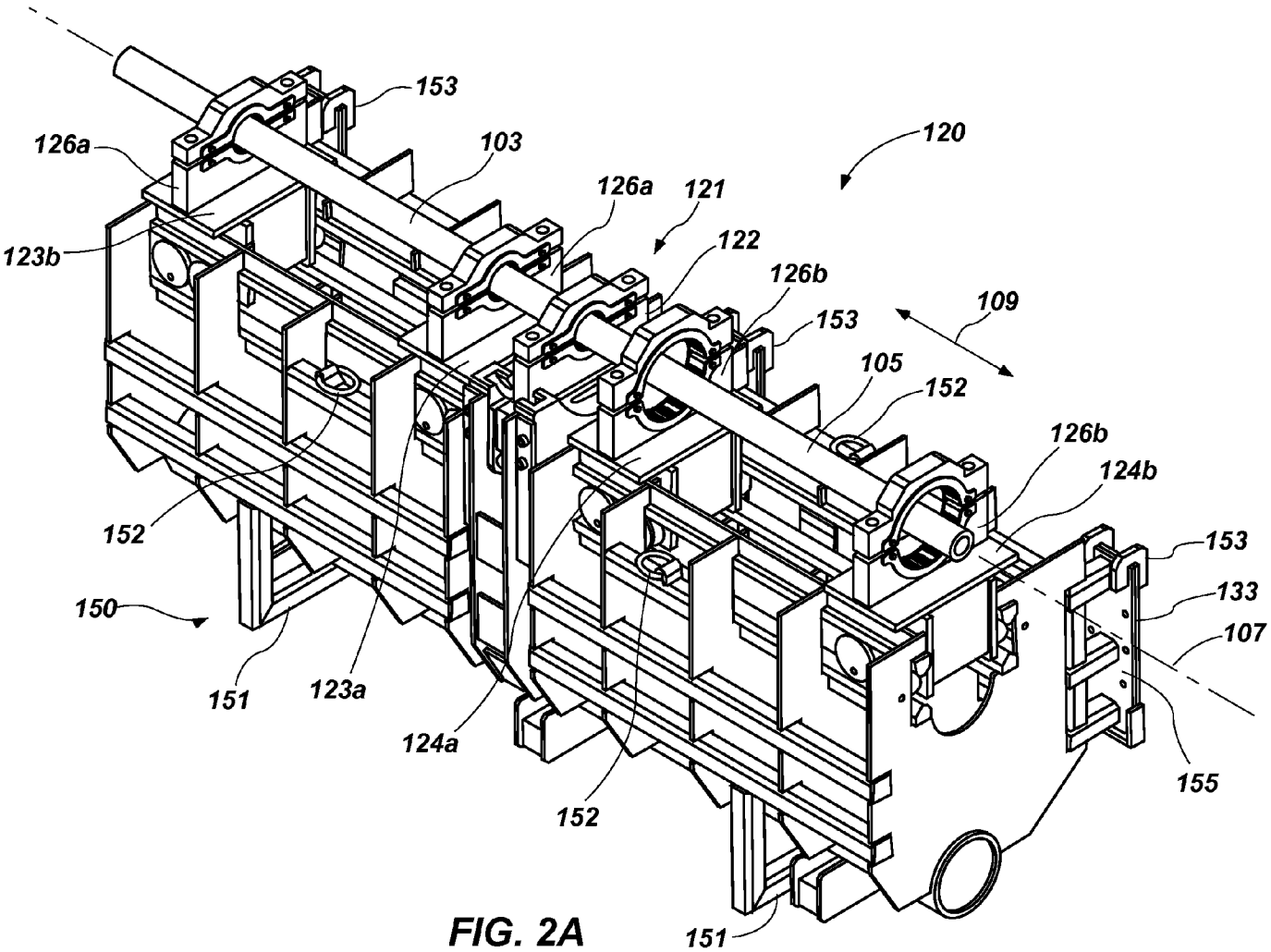
FIGS. 2A and 2B are isolated views of a bucking unit of the wellbore equipment handling device of FIGS. 1A-1C.
Figure 2B:
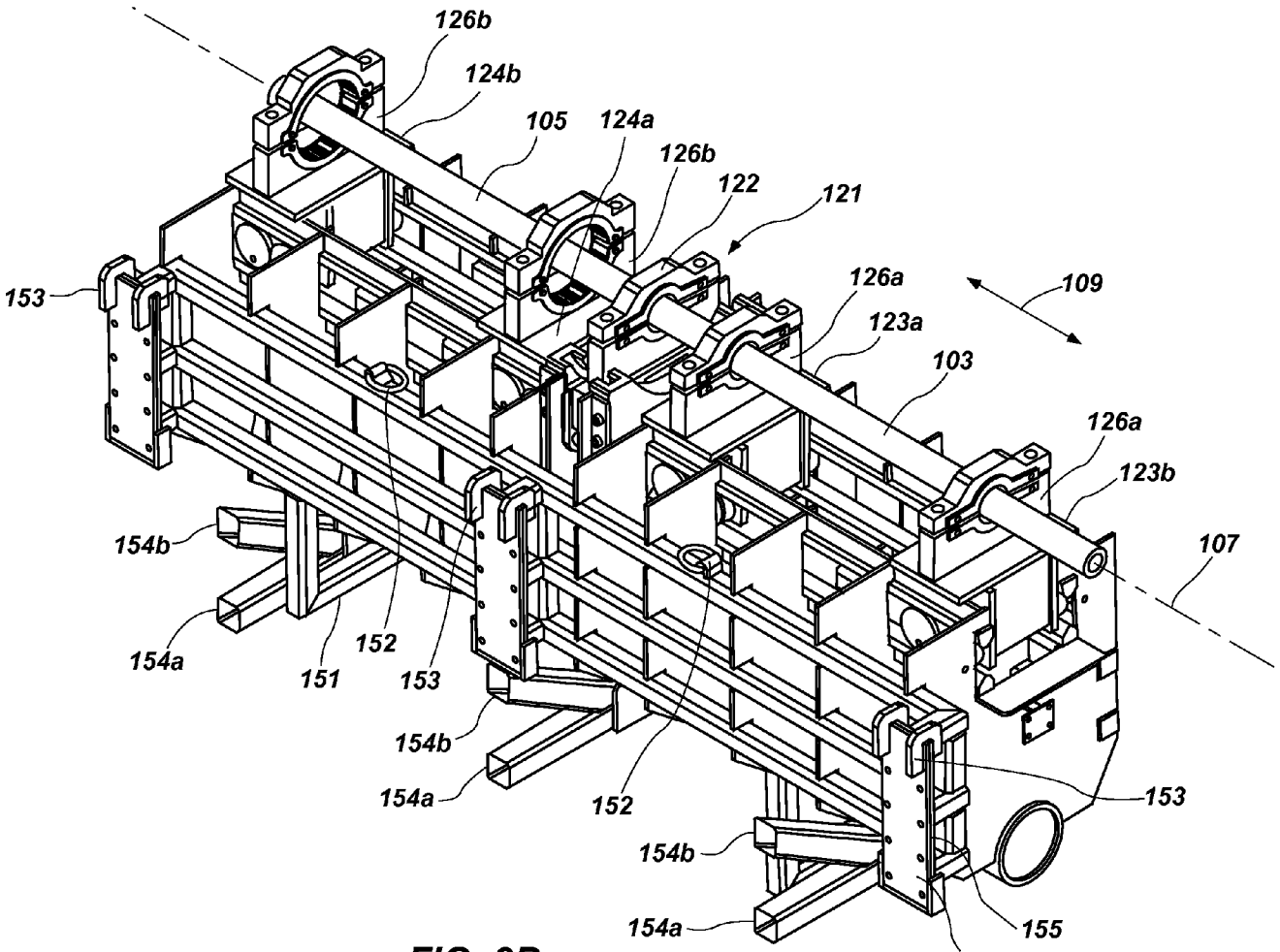
Figure 3:
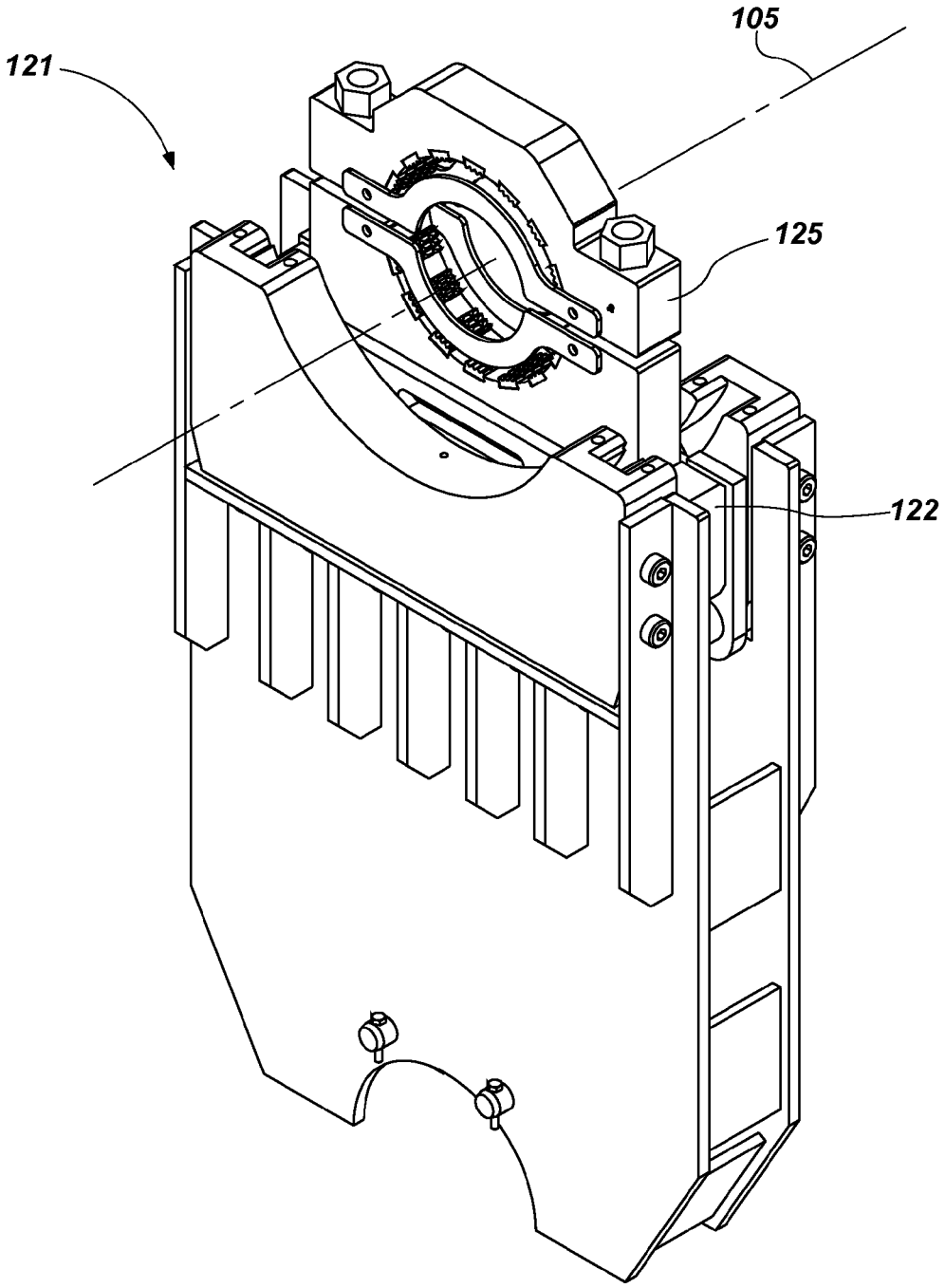
FIG. 3 is an isolated view of a torqueing assembly of the bucking unit of FIGS. 2A and 2B.
Figure 4B:
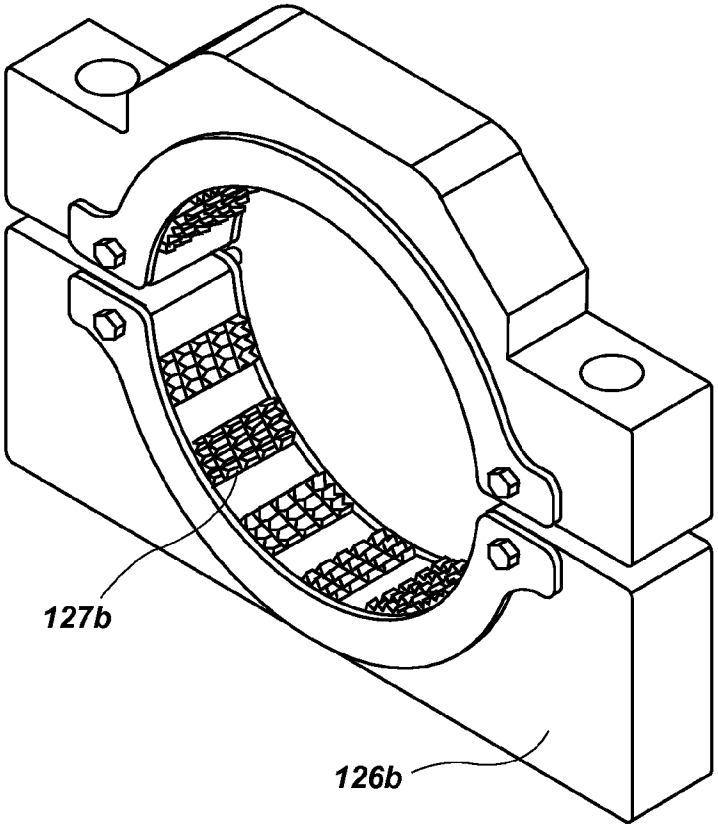
FIG. 4B is an example illustration of a pipe carrier of the bucking unit of FIGS. 2A and 2B in accordance with another embodiment of the present disclosure.
Figure 4A:
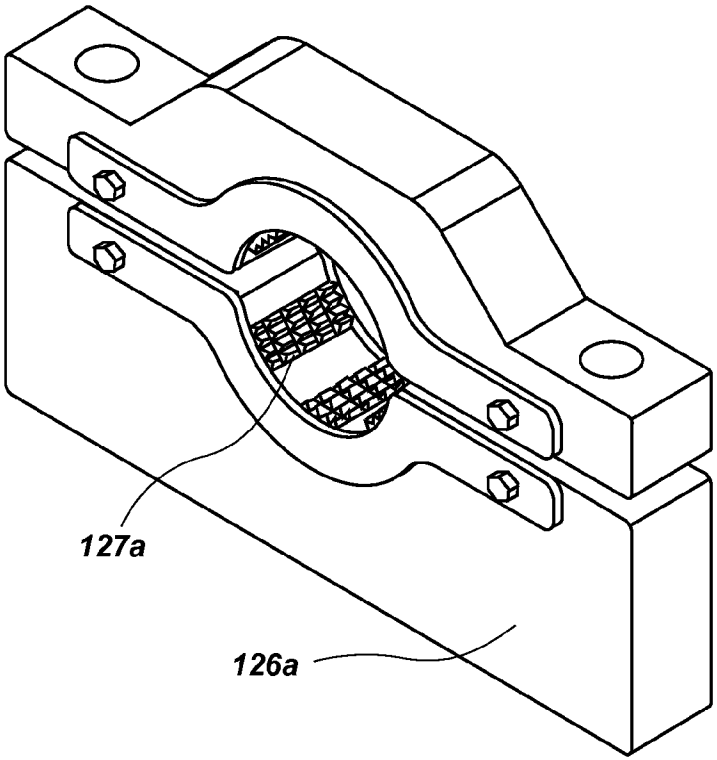
FIG. 4A is an example illustration of a pipe carrier of the bucking unit of FIGS. 2A and 2B in accordance with an embodiment of the present disclosure.

FIGS. 2A and 2B illustrate the bucking unit 120 isolated from the catwalk for illustration purposes. The bucking unit 120 comprises a torqueing assembly 121, including a torque arm 122, and saddle trolleys 123*a*, 123*b*, 124*a*, 124*b*. An isolated view of the torqueing assembly 121 is shown in FIG. 3. The torque arm 122 can be configured to clamp a tubular or downhole tool with an appropriate die 125, which can be interchangeable for a given tubular size and/or tool type. In one aspect, the die 125 can be configured to clamp the tubular using a threaded fastener, such as a bolt and a nut. Examples of such tools include a hydraulic set packer, tubing pups, a wash pipe, a landing nipple, a lock mandrel, a wireline retry guide, and any other suitable tool, such as a tool for completing a well. In one aspect, the torqueing assembly 121 can comprise a tong. The torque arm 122 can be configured to rotate about an axis 107 to couple or uncouple tubulars or downhole tools, which may have threaded coupling features. The torque arm 122 can be configured to provide any suitable amount of torque, such as up to about 20,000 lb-ft. The torque arm 122 is prevented from translational movement along the axis 107. In the embodiment illustrated, two pairs of saddle trolleys 123*a-b* and 124*a-b* are disposed on opposite sides of the torque arm 122. A tubular 103 or downhole tool, such as a drill bit or bottom hole assembly, can be clamped on the saddle trolleys by carriers 126*a*, 126*b* supported about the saddle trolleys, the carriers having dies configured to engage the tubular or downhole tool. Isolated views, for illustration purposes, of a carrier and die assemblies, namely carriers 126*a*, 126*b* having dies 127*a*, 127*b*, respectively, of different sizes are shown in FIGS. 4A and 4B to accommodate different sizes of tubulars, such as from about 2 inches in diameter up to about 10 inches in diameter. The carriers 126*a*, 126*b* and/or dies 127*a*, 127*b* can be interchangeable for a given tubular size and/or tool type. In one aspect, the carriers 126*a*, 126*b* and/or dies 127*a*, 127*b* can be configured to clamp a tubular or tool using a threaded fastener, such as a bolt and a nut.

The saddle trolleys 123*a-b* and 124*a-b* can be configured to move in direction 109 parallel to the axis 107 relative to the torque arm 122 to facilitate coupling or uncoupling tubulars or downhole tools. For example, the tubular 103 can be clamped and secured to the saddle trolleys 123*a-b* to restrict rotational movement of the tubular 103 about the axis 107, and the torque arm 122 can be clamped and secured to a tubular 105, which is in an end-to-end configuration with the tubular 103. Rotation of the torque arm 122 to couple or uncouple a threaded coupling of the tubulars 103, 105 will tend to move the saddle trolleys 123*a-b* in direction 107 parallel to the axis 105. Thus, the saddle trolleys 123*a-b*, 124*a-b* can be free to move back and forth in direction 107 along the axis 105, as necessary, during make-up or break-up of a connection under the influence of the torque arm 122. As illustrated, the saddle trolleys 124*a-b* on the opposite side of the torque arm 122 from saddle trolleys 123*a-b* are not in support of the tubular 105. However, in one aspect, the saddle trolleys 124*a-b* can have carriers sized to support the tubular 105 or downhole tool being coupled or uncoupled. In this case, the carriers and/or dies need not be clamped or secured to the tubular 105 or downhole tool, as such a condition will inhibit operation of the torque arm 122 to couple or uncouple the connection. The saddle trolleys 123*a-b*, 124*a-b* can have any suitable range of travel. In one aspect, the saddle trolleys 123*a-b*, 124*a-b* can have up to about 40 inches of travel.

Referring again to FIGS. 2A and 2B, the bucking unit 120 can also include a base 150 configured to support the bucking unit 120 components described herein. In one aspect, the bucking unit base 150 can be configured to support the bucking unit 120 in a "stand alone" configuration uncoupled to the catwalk. For example, the bucking unit base 150 can include one or more support members 151 configured to interface with a support surface and to maintain stable support of the bucking unit 120 on the support surface when in use. The bucking unit 120 can also be configured for transport, such as by lilting or hoisting the bucking unit 120 via lifting features 152, such as D-rings or hooks. The bucking unit base 150 can also be configured to facilitate transport of the bucking unit 120 by a forklift or other carrier vehicle, such as by having openings or channels formed therein, such as to receive forklift forks.

With further reference to FIGS. 1A-2B, the bucking unit base 150 can also be configured to couple with the catwalk base 112 in order to integrate the catwalk 110 and bucking unit 120 as described herein. For example, the bucking unit base 150 can have mounting hooks 153 to engage a mounting structure 133 of the catwalk base 112, such as a plate (shown isolated from the catwalk base 112 for convenience). The mounting structure 133 of the catwalk base 112 can be located in any suitable location. For example, the mounting structure 133 can be located on one or both sides of the catwalk 110, or longitudinally or vertically anywhere along the catwalk 110. Thus, in one aspect, the catwalk base 112 can be configured to provide multiple coupling locations for the bucking unit 120, such that the bucking unit 120 can be positioned, as desired, about the catwalk 110. Lateral supports 154*a*, 154*b* of the bucking unit base 150 can be configured to contact the catwalk base 112 to stabilize the bucking unit 120 when hanging by the mounting hooks 153. Fastening plates 155 on the bucking unit base 150 and the mounting structure 133 of the catwalk base 112 can be configured to receive threaded fasteners to securely couple the bucking unit 120 to the catwalk 110. The mounting hooks 153 and lateral supports 154*a*, 154*b* can support the bucking unit 120 prior to and during fastening of the fastening plates 155 to the mounting structure 133 to securely couple the bucking unit 120 to the catwalk 110.

The wellbore equipment handling device/system 100 as described herein can provide the dual functions of tubular movement and manipulation as well as coupling and uncoupling tubulars and/or downhole tools. In one aspect, the integrated catwalk 110 and bucking unit 120 can be fully functional independent of one another. In another aspect, the integrated catwalk 110 and bucking unit 120 can function together to move tubulars for coupling and uncoupling with other tubulars or with downhole tools.

It is to be understood that the embodiments of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular embodiments only and is not intended to be limiting.

Reference throughout this specification to "one embodiment" or "an embodiment" means that a particular feature, structure, or characteristic described in connection with the embodiment is included in at least one embodiment of the present invention. Thus, appearances of the phrases "in one embodiment" or "in an embodiment" in various places throughout this specification are not necessarily all referring to the same embodiment.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various embodiments and example of the present invention may be referred to herein along with alternatives for the various components thereof. It is understood that such embodiments, examples, and alternatives are not to be construed as de facto equivalents of one another, but are to be considered as separate and autonomous representations of the present invention.

Furthermore, the described features, structures, or characteristics may be combined in any suitable manner in one or more embodiments. In the description, numerous specific details are provided, such as examples of lengths, widths, shapes, etc., to provide a thorough understanding of embodiments of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the foregoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

What is claimed is:

1. A wellbore equipment handling device and system, comprising:

a catwalk to facilitate movement of a tubular, the catwalk having a trough to receive the tubular, the trough extending longitudinally along the catwalk, a base to support the trough, a frame in support of the trough, wherein the frame is pivotally coupled to the base, and movable to elevate a portion of the trough above the base, and at least one indexer for moving the tubular onto or off of the catwalk; and a bucking unit coupled to the base of the catwalk and configured to couple and uncouple joints of tubulars and downhole tools, wherein the indexer is operable to move the tubulars to the bucking unit from the catwalk and from the bucking unit to the catwalk.

2. The wellbore equipment handling device and system of claim 1, wherein the trough comprises first and second components movable relative to one another to extend and retract a length of the trough.

3. The wellbore equipment handling device and system of claim 1, wherein the indexer comprises an arm pivotally coupled to the base, and an upper surface configured to interface with a tubular, and wherein the arm is caused to rotate to maneuver the tubular.

4. The wellbore equipment handling device and system of claim 1, wherein the catwalk further comprises a kicker for moving the tubular out of the trough and toward the indexer, and wherein the indexer is operable to move the tubular into the trough.

5. The wellbore equipment handling device and system of claim 4, wherein the kicker is operable with an actuator to cause the kicker to protrude above the trough through an opening formed in the trough, and wherein the kicker is mounted in a recess so as to have an upper surface situated flush or below a surface of the trough in a non-extended or retracted position.

6. The wellbore equipment handling device and system of claim 4, wherein the catwalk further comprises a skate to move the tubular along the trough.

7. The wellbore equipment handling device and system of claim 6, wherein the skate moves in a bi-directional manner along a longitudinal path along the trough.

8. The wellbore equipment handling device and system of claim 6, wherein the skate comprises a push plate operable to move the tubular toward the end of the trough, and a clamp to move the tubular in a direction away from the end of the trough, the push plate and clamp being operable with a drive mechanism to actuate the skate.

9. The wellbore equipment handling device and system of claim 6, wherein the indexer, the kicker and the skate are operable to function alone or in any combination to move and position the tubular about the catwalk.

10. The wellbore equipment handling device and system of claim 1, further comprising multiple indexers located about opposite sides of the catwalk.

11. The wellbore equipment handling device and system of claim 1, wherein the bucking unit is coupled to the base of the catwalk in a location suitable to facilitate transfer of the tubular to and from the catwalk.

12. The wellbore equipment handling device and system of claim 1, wherein the catwalk and bucking unit are mobile.

13. The wellbore equipment handling device and system of claim 1, wherein the base is levelable relative to ground.

14. The wellbore equipment handling device and system of claim 1, further comprising a control unit operable to control the functionality of the various components of the wellbore equipment handling device and system.

15. The wellbore equipment handling device and system of claim 1, wherein the bucking unit comprises a torqueing assembly operable to couple and uncouple the tubular with a second tubular.

16. The wellbore equipment handling device and system of claim 15, wherein the torqueing assembly comprises:

a torque arm having a die configured to clamp the tubular, the torque arm being configured to rotate to rotate the tubular;

at least one saddle trolley operable to move relative to the torque arm; and a carrier disposed about the saddle trolley and having a die to clamp the second tubular, wherein the torque arm, the saddle trolley and the carrier facilitates coupling or uncoupling of the tubular and the second tubular.

17. The wellbore equipment handling device and system of claim 16, wherein rotation of the torque arm to couple or uncouple the tubular and the second tubular functions to move the saddle trolley under influence of the torque arm.

18. The wellbore equipment handling device and system of claim 16, wherein the dies or the carriers are interchangeable to accommodate a different sized tubular.

19. The wellbore equipment handling device and system of claim 1, wherein the bucking unit further comprises a base in support of the components of the bucking unit.

20. The wellbore equipment handling device and system of claim 19, wherein the base of the bucking unit is coupleable with the base of the catwalk to integrate the catwalk and the bucking unit.

21. The wellbore equipment handling device and system of claim 19, wherein the base of the bucking unit is coupleable with the base of the catwalk along multiple coupling locations, such that the bucking unit can be positioned as desired about the catwalk.

22. A system for facilitating wellbore operations, the system comprising:

a catwalk having a base;

a trough supported about the base, the trough being configured to receive a tubular;

a frame in support of the trough, wherein the frame is pivotally coupled to the base, and movable to elevate a portion of the trough above the base;

a plurality of indexers coupled to the base and spaced longitudinally, the indexers being operable alone or in combination to manipulate movement of the tubular relative to the trough;

at least one kicker located along the length of the trough and operable to move the tubular out of the trough towards the indexers; and a torqueing assembly supported about the trough, the torqueing assembly being operable to facilitate coupling or uncoupling of a second tubular and/or a downhole tool, wherein movement of either of the tubular or the second tubular is secured relative to movement of the other or the downhole tool, and wherein the indexers are configured to move the tubular to the torqueing assembly from the catwalk and from the torqueing assembly to the catwalk.

23. The system of claim 22, further comprising a skate configured to move the tubular in a longitudinal direction within the trough.

24. The system of claim 22, wherein the torqueing assembly comprises a torque arm and one or more saddle trolleys in support of a carrier and die assembly.

25. A method for facilitating tubular handling and coupling/uncoupling from a single wellbore equipment handling device and system, the method comprising:

providing a catwalk operable to handle and manipulate tubulars, the catwalk having at least one indexer for moving the tubulars onto or off of the catwalk, a trough to receive the tubulars, the trough extending longitudinally along the catwalk, a base to support the trough, and a frame in support of the trough, wherein the frame is pivotally coupled to the base, and movable to elevate a portion of the trough above the base;

integrating a bucking unit with the catwalk, the bucking unit operable to couple and uncouple joints of the tubulars and downhole tools, wherein the at least one indexer is operable to move the tubulars to the bucking unit from the catwalk and from the bucking unit to the catwalk.

26. The method of claim 25, further comprising configuring the trough to comprise first and second components movable relative to one another to facilitate extension and retraction of a length of the trough.

27. The method of claim 25, further comprising configuring the catwalk with a kicker for moving the tubular out of the trough and toward the indexer, and wherein the indexer is operable to move the tubular into the trough.

28. The method of claim 25, further comprising configuring the catwalk with a skate operable to move the tubular along the trough.

29. The method of claim 25, further comprising facilitating the coupling of the bucking unit to the base of the catwalk in a location suitable to facilitate transfer of the tubular to and from the catwalk.

30. The method of claim 25, further comprising configuring the bucking unit with a torqueing assembly operable to couple and uncouple the tubulars.

31. A method for facilitating, at least in part, wellbore operations, the method comprising:

obtaining a wellbore equipment handling device comprising a combination of a catwalk and bucking unit integrated with one another, the catwalk having a trough to receive tubulars, the trough extending longitudinally along the catwalk, a base to support the trough, and a frame in support of the trough, wherein the frame is pivotally coupled to the base, and movable to elevate a portion of the trough above the base, at least one indexer for moving the tubulars onto or off of the catwalk, wherein the at least one indexer is operable to move the tubulars to the bucking unit from the catwalk and from the bucking unit to the catwalk; and operating the wellbore equipment handling device to move one or more tubulars and/or downhole tools, and to couple and/or uncouple the joints of the tubulars and the downhole tools.

* * * * *